US011191690B2

(12) United States Patent
Tu

(10) Patent No.: US 11,191,690 B2
(45) Date of Patent: Dec. 7, 2021

(54) DEVICE AND METHOD FOR A PORTABLE PRONE SURGICAL POSITIONING

(71) Applicant: Cong Thanh Diep Tu, Ho Chi Minh (VN)

(72) Inventor: Cong Thanh Diep Tu, Ho Chi Minh (VN)

(73) Assignee: Ton Duc Thang University, Ho Chi Minh (VN)

( * ) Notice: Subject to any disclaimer, the term of this patent is extended or adjusted under 35 U.S.C. 154(b) by 0 days.

(21) Appl. No.: 15/607,431

(22) Filed: May 27, 2017

(65) Prior Publication Data

US 2021/0154075 A1 May 27, 2021

(51) Int. Cl.

| | |
|---|---|
| ***A61G 13/12*** | (2006.01) |
| ***A61G 13/02*** | (2006.01) |
| ***A61G 13/10*** | (2006.01) |

(52) U.S. Cl.

CPC ..... *A61G 13/105* (2013.01); *A61G 13/02* (2013.01); *A61G 13/122* (2013.01); *A61G 13/129* (2013.01); *A61G 13/1225* (2013.01); *A61G 13/1295* (2013.01); *A61G 13/1235* (2013.01)

(58) Field of Classification Search

CPC .... A61G 13/105; A61G 13/02; A61G 13/122; A61G 13/129; A61G 13/1225; A61G 13/1295

See application file for complete search history.

(56) References Cited

U.S. PATENT DOCUMENTS

| | | | | |
|---|---|---|---|---|
| 6,076,525 A * | 6/2000 | Hoffman | ..... | A61G 13/12 128/845 |
| 7,587,770 B1 * | 9/2009 | Reser | ..... | A61G 13/009 128/845 |
| 2014/0090167 A1 * | 4/2014 | Hillenbrand, II | .... | A61G 7/1026 5/81.1 HS |

FOREIGN PATENT DOCUMENTS

| | | | | |
|---|---|---|---|---|
| WO | WO-2014076546 A1 * | 5/2014 | ..... | A61G 13/122 |

OTHER PUBLICATIONS

US 10,849,807, Aug. 2016, Lim; Roy withdrawn*

* cited by examiner

*Primary Examiner* — David R Hare
*Assistant Examiner* — Madison Emanski

(57) ABSTRACT

A method and a portable prone surgical positioning device are provided which includes: a base frame assembly having a length varying assembly; a pair of chest supporting frames for a patient to lay in prone position thereupon; a width varying assembly connected to the pair of chest supporting frames; and a curvature varying assembly, connected to the base frame assembly and the width varying assembly, operable to change a curvature of the pair of chest supporting frames.

20 Claims, 8 Drawing Sheets

DEVICE AND METHOD FOR A PORTABLE PRONE SURGICAL POSITIONING

FIELD OF THE INVENTION

The present invention relates generally to the field of medical devices. More specifically, the present invention relates to prone surgical positioning device.

BACKGROUND ART

Positioning patients properly during a spinal surgery is critical to providing the best care possible and protecting against devastating complications. For example, a teenager girl has grown four inches after having corrective surgery on her curved spine. A five years old child has been able to rely less on her walker and wheelchair, and more on her won two fee because of a spinal surgery. A football player was able to return to his career because of the spinal surgery to fix his cervical spinal stenosis. Each patient—a years old girl, a teenager girl, and a football player, etc.—has different size and correct spinal surgery position. Therefore, providing the exact spinal surgical positions for different patients is essential for every spinal surgery devices.

Conventional spinal surgery frames such as Wilson Spinal Surgery Frame has a frame, a crank handle, and a driver mechanism. The crank handle is used to crank the drive mechanism to raise up the frame to provide the correct position for each patient. However, the crank handle and the drive mechanism takes excessive time to operate in a busy setting and cannot provide the exact position for each patient. Furthermore, the Wilson Frame often causes the patient discomfort because the frame pads do not have the correct curvature or inclination.

Other prone support devices include multiple pieces or moving parts which complicate the set up and operation of the frame. These frames cannot provide the exact position for each patient and take excessive time to assemble them together. Patients who are in a great pain and discomfort cannot wait for too long to assemble the prone support devices. After assembly, these patients lie on these frames for at least 15 minutes for the medical assistants find the correct positions—which includes length, pad curvature, and width. This delay does not only cause a great discomfort, create devastating results, but also interfere with the breathing of every patient.

Therefore what is needed is a prone surgical device that can overcome the above described problems.

SUMMARY OF THE INVENTION

Accordingly, an objective of the present invention is to provide a portable prone surgical positioning device are provided which includes: a base frame assembly having a length varying assembly; a pair of chest supporting frames for a patient to lay in prone position thereupon; a width varying assembly connected to the pair of chest supporting frames; and a curvature varying assembly, connected to the base frame assembly and the width varying assembly, operable to change a curvature of the pair of chest supporting frames.

Another objective of the present invention is to provide a method of using a portable prone surgical positioning device which includes the steps of removing the portable prone surgical positioning device from a briefcase, extending the portable prone surgical positioning device into specific prone surgical position measurements for a specific patient using a controller, connecting a pair of chest supporting frames into the prone surgical positioning device, and reducing the portable surgical positioning device to its original size that fits into the briefcase.

These and other advantages of the present invention will no doubt become obvious to those of ordinary skill in the art after having read the following detailed description of the preferred embodiments, which are illustrated in the various drawing Figures.

BRIEF DESCRIPTION OF THE DRAWINGS

The accompanying drawings, which are incorporated in and form a part of this specification, illustrate embodiments of the invention and, together with the description, serve to explain the principles of the invention.

DETAILED DESCRIPTION OF THE INVENTION

Reference will now be made in detail to the preferred embodiments of the invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following detailed description of the present invention, numerous specific details are set forth in order to provide a thorough understanding of the present invention. However, it will be obvious to one of ordinary skill in the art that the present invention may be practiced without these specific details. In other instances, well-known methods, procedures, components, and circuits have not been described in detail so as not to unnecessarily obscure aspects of the present invention.

Figure 1:
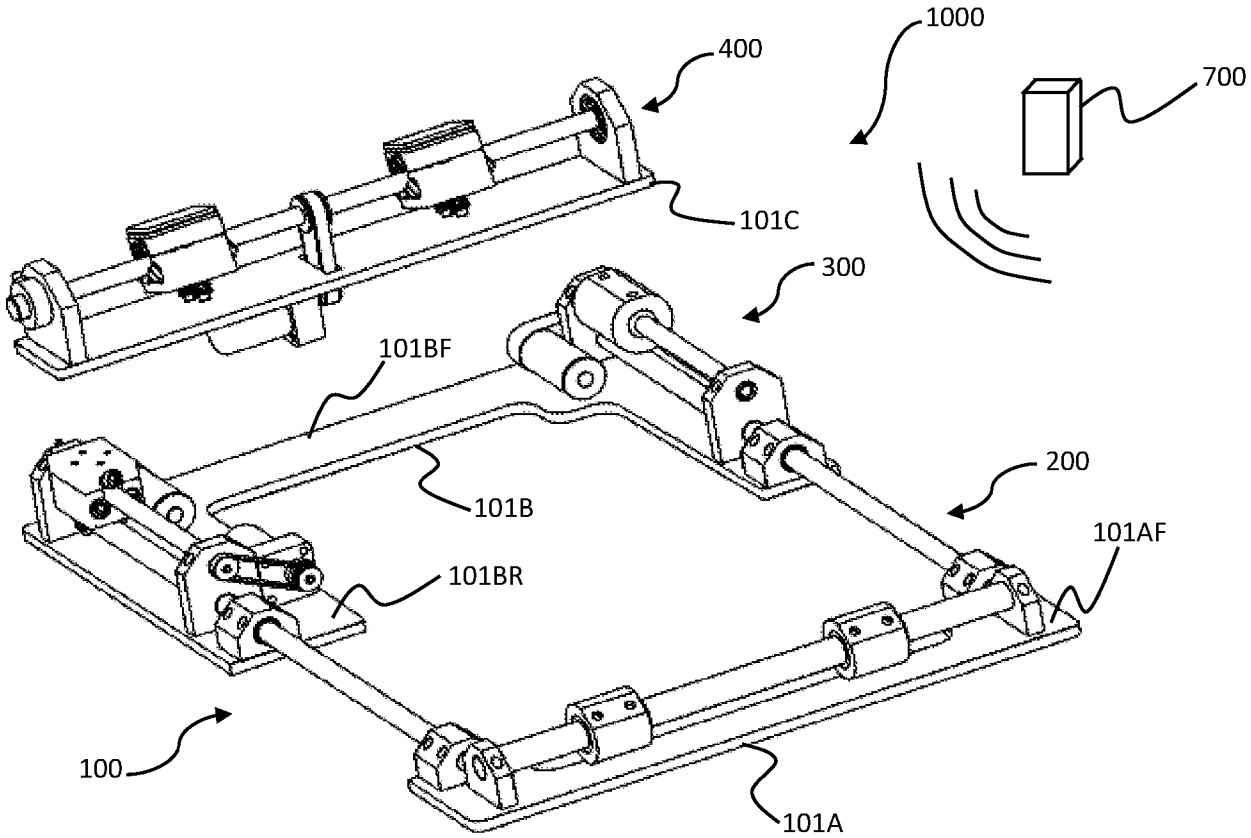
FIG. 1 is a 3D diagram illustrating three main components of a portable surgical prone positioning device in accordance with an embodiment of the present invention.

One embodiment of the invention is now described with reference to FIGS. 1 to 6. FIG. 1 is a diagram illustrating the main components of a portable prone surgical positioning device 1000 in accordance with an exemplary embodiment of the present invention. The first component is a base frame assembly 100. In different embodiments, base frame assembly 100 further includes a first platform 101A and a second platform 101B. First platform 101A has a top front end 101AF and a rear front end 101AR. Second platform 101B has a top front end 101BF and a top rear end 101BR. The second component is a length varying assembly 200 designed to vary the length of portable prone surgical positioning device 1000. The third component is a curvature varying assembly 300 designed to vary the curvature of a pair of chest supporting frames (not shown, will be shown in later figures). The fourth component is a width varying assembly 400 designed to vary the width between the pair of chest supporting frames. Finally, a controller 700 designed to control the movements of length varying assembly 200, curvature varying assembly 300, and width vary assembly 400. In an exemplary embodiment, controller 700 is designed to store and retrieve specific prone position measurements of a specific patient from a memory (not shown). Then controller 700 uses the specific prone position measurements to adjust length varying assembly 200, curvature varying assembly 300, and width varying assembly 400 to a size that best fits a specific patient.

Continuing with FIG. 1, in many embodiments of the present invention, specific prone surgical measurements include the width between the pair of chest supporting frames (not shown) controlled by width varying assembly 400, the length of base frame assembly 100 controlled by length varying assembly 200, and the curvature controlled by curvature varying assembly 300. The curvature is the arc length in radians of the pair of chest supporting frames (not shown). More specifically, the curvature is determined by the arc length subtended by the distance between the two extreme ends of the pair of chest supporting frames (not shown). For example, a patient A is a 4 feet tall, 55 pounds child. The specific prone position measurements of patient A include 250 mm in width provided by curvature varying assembly 300, 500 mm in length provided by length varying assembly 200, and a curvature of the pair of chest supporting frames is 650 rads provided by curvature varying assembly 300. Controller 700 stores the prone surgical position measurements of patient A in the first location of the memory device. Another patient B is a 6 feet 6 inches, 300 pounds adult and his specific prone surgical position measurements is 500 mm in width, 750 mm in length and curvature is 1050 rads. Controller 700 stores the prone position information of patient B in the second location of the memory device.

The prone surgical position measurements of patient A, patient B, and other patients are summarized in the following table:

| | Width | Length | Curvature |
|---|---|---|---|
| Patient A | 250 mm | 500 mm | 650 mm |
| Patient B | 550 mm | 750 mm | 1050 mm |
| . . . | | | |

When patient A needs to use portable surgical prone positioning device 1000, controller 700 retrieves the specific prone position information of patient A and controls length varying assembly 200, curvature varying assembly 300, and width varying assembly 400 to move to the correct prone position of patient A as specified in the table above. The same procedure is also applied for patient B. In one exemplary embodiment, controller 700 can be a cellular phone having an app to control portable surgical prone positioning device 1000. In another exemplary embodiment, controller 700 can be a desktop computer. Yet, in another exemplary embodiment, controller 700 can be a pointer or a remote control device.

Figure 2:
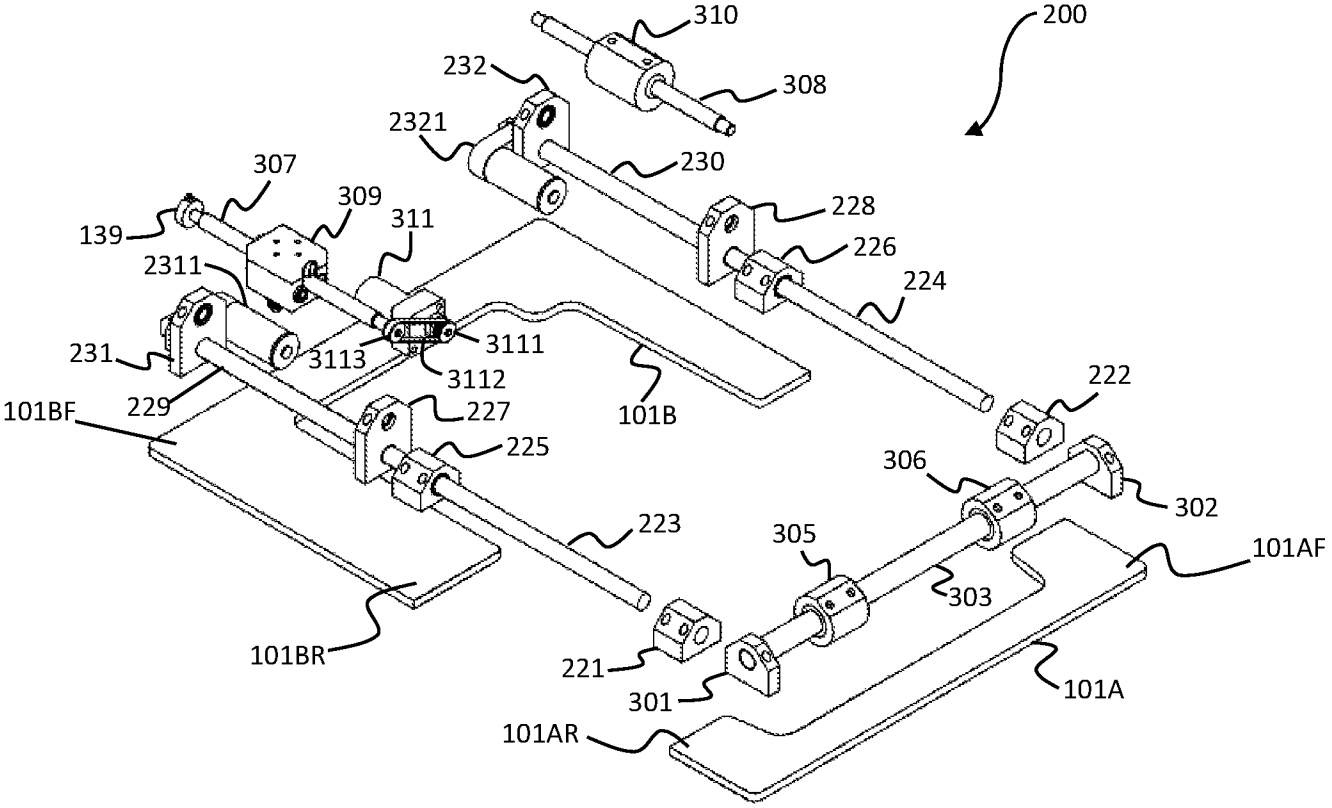
FIG. 2 is a 3D diagram illustrating a base frame assembly, a length varying assembly, and a curvature varying assembly of the portable surgical prone positioning device in accordance with an embodiment of the present invention.

Now, referring to FIG. 2, a 3D diagram 2000 of length varying assembly 200 and curvature varying device 300 components of prone surgical positioning device 1000 in accordance with an exemplary embodiment of the present invention is illustrated. In diagram 2000, all components designated with 200s reference numbers are parts of an exemplary embodiment of length varying assembly 200. All components designated with 300s reference number are parts of an exemplary embodiment of curvature varying assembly 300.

Continuing with FIG. 2, length varying assembly 200 includes the following components: a first connector 221, a second connector 222, a third connector 225, a fourth connector 226, a first longitudinal sliding beam 223, a second longitudinal sliding beam 224, a first vertical double-barrel connector 227, a second vertical double-barrel 228, a third vertical double-barrel connector 231, a fourth vertical double-barrel 232, a first longitudinal hollow tube 229, a second longitudinal hollow tube 230, a first linear actuator 2311, a second linear actuator 2321, a first position sensor 233, and a second position sensor 233. In some embodiments, first linear actuator 2311 and second linear actuator 2321 are manufactured by Roh'lix® having a thrust capacity ranging from 15 to 200 lbs (67 to 889N).

Continuing with FIG. 2 and the description of length varying assembly 200. First connector 221 is fixedly connected to the left hand side on top rear end 101AR of first platform 101A. Second connector 222 is fixedly connected to the right hand side on top rear end 101AR of first platform 101A. Third connector 225 is fixedly connected to the left hand side on top rear end 101BR of second platform 101B, aligned in a straight line with first connector 221. Similarly, fourth connector 226 is fixedly connected to the right hand side on top rear end 101BR of second platform 101B, aligned in a straight line with second connector 222. First vertical double-barrel connector 227 is fixedly connected to the left hand side of top rear end 101BR of second platform 101B, adjacent to third connector 225. Similarly, second vertical double-barrel connector 228 is fixedly connected to the right hand side of top rear end 101BR of second platform 101B, adjacent to fourth connector 225. Third vertical double-barrel connector 231 is fixedly connected to the left hand side of top front 101BF of second platform 101B and fourth vertical double-barrel connector 232 is fixedly connected to the right hand side of top front 101BF of second platform 101B.

Still continuing with FIG. 2, first longitudinal beam 223 is fixedly connected to first connector 221 and slidably connected to third connector 225. One end of first hollow tube 229 is connected to the first level of first vertical double-barrel connector 227 and first longitudinal sliding beam 223. The other end of first hollow tube 229 is fixedly connected to the first level of first vertical double-barrel connector 231 and to first linear actuator 2311. Similarly, Second longitudinal sliding beam 224 is fixedly connected to second connector 222 and slidably connected to fourth connector 226. One end of second hollow tube 230 is connected to the first level of second vertical double-barrel connector 228 and second longitudinal sliding beam 224. The other end of second hollow tube 230 is fixedly connected to the first level of second vertical double-barrel connector 232 and to second linear actuator 2321. When first linear actuator 2311 and second linear actuator 2321 are activated by controller 700 to extend the length of first platform 101, first longitudinal sliding beam 223 and second sliding longitudinal 224 are pushed out of first hollow tube 229 and second hollow tube 230 respectively. On the other hand, controller 700 commands first linear actuator 2311 and second linear actuator 2321 to retract first longitudinal sliding arm 223 and second longitudinal sliding arm 224 into first hollow tube 229 and second hollow tube 230 respectively.

Continuing with FIG. 2 and the description of curvature varying assembly 300. To begin with, curvature varying assembly 300 includes a fifth connector 301, a sixth connector 302, a first horizontal sliding beam 303, a first sliding connector 305, a second sliding connector 306, a third longitudinal sliding beam 307, a fourth longitudinal sliding beam 308, a linear actuator connector 309, a third sliding connector 310, and a first motor 311. Specifically, fifth connector 301 and sixth connector 302 are located on two sides of top front end 101AF of first platform 101A. First horizontal sliding beam 303 is firmly connected between fifth connector 301 and sixth connector 302. First sliding connector 305 and second sliding connector 306 are coupled to slide freely along first horizontal sliding bar 303. Third longitudinal sliding beam 307 is connected to the second connector of first and third vertical double-barrel connectors 227 and 231 respectively. First motor 311 is coupled to third longitudinal sliding beam 307 via a first puley 3111, a belt 3112, and a second pulley 3113. First linear actuator connector 309 is coupled to move back and forth along third longitudinal sliding beam 307 when first motor 311 is rotating. Similarly, fourth longitudinal sliding beam 308 is connected to the second levels of second and fourth vertical double-barrel connectors 228 and 232 respectively. First linear actuator connector 309 is coupled to move along fourth longitudinal sliding beam 308 in unison with first linear actuator connector 309 as first motor 311 rotates. In one exemplary embodiment, a sensor 139 is coupled to third longitudinal sliding beam 307 to record the position of first linear actuator connector 309.

Figure 3:
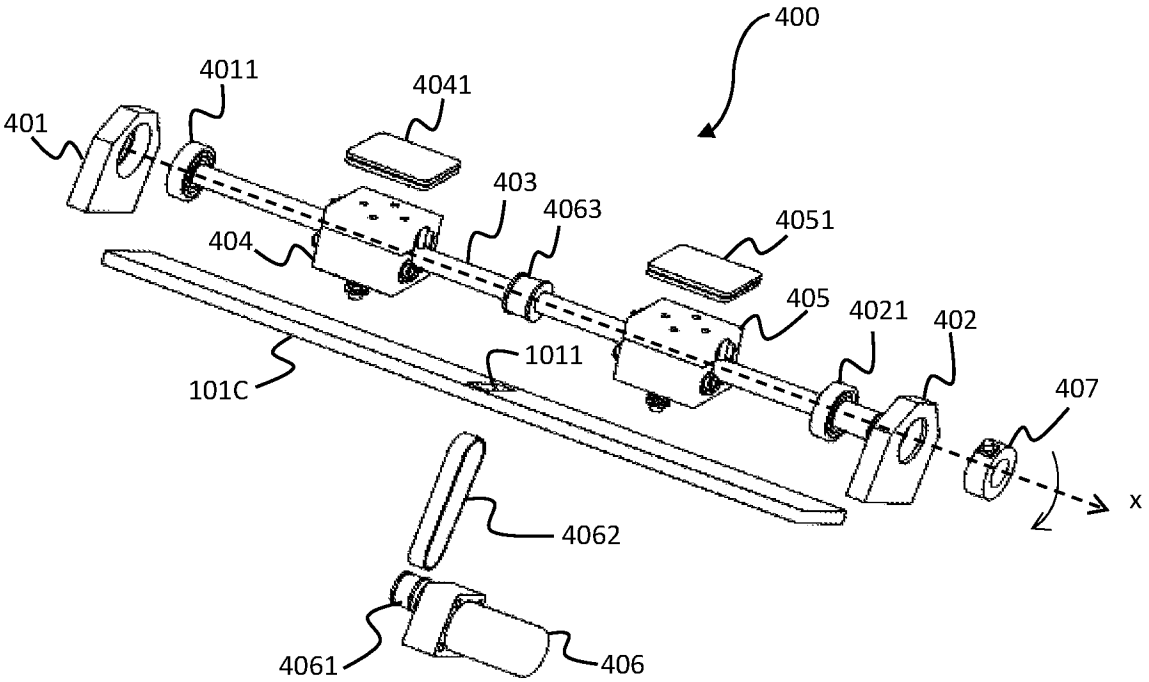
FIG. 3 is a 3D diagram illustrating a width varying assembly of the portable surgical prone positioning device in accordance with an embodiment of the present invention.

Referring next to FIG. 3 illustrating width varying assembly 400 and its components in accordance to an exemplary embodiment of the present invention. Width varying assembly 200 includes a third platform 101C, a seventh connector 401, an eight connector 402, a second horizontal sliding beam 403, a second linear actuator connector 404, a third linear actuator connector 405, and a second motor 406. Specifically, seventh connector 501 and eighth connector are fixedly connected to the two sides of third platform 101C. A pair of rotating ring 4011 and 4021 are coupled to seventh connector 401 and eighth connector 402 to that second horizontal sliding beam 403 can rotate along an axis x. Second linear actuator connector 404 and third linear actuator connector 405 are coupled to move in opposite direction from each other along second horizontal sliding beam 403. An opening 1011 is cut in the middle of third platform 101C. Second motor 406 is coupled to rotate second horizontal sliding beam 403 by a first pulley, a belt 4062, and a second pulley 4063. As shown in FIG. 3, belt 4062 goes through opening 1011 to couple first pulley 4061 and second pulley 4063. In other embodiments, any devices, means that rotate second horizontal sliding beam 403 which causes second linear actuator connector 404 and third linear actuator connector 405 to move are within the scope of the present invention. In another exemplary embodiment, a second sensor 407 is connector to one end of second horizontal sliding beam 403 to record the positions of second and third linear actuator connector 404 and 405 respectively. Second linear actuator connector 404 has a cushion 4041 and third linear actuator connector 405 has a cushion 4051. In an exemplary embodiment, first motor 311 and second motor 406 are DC motors with 24 volts, 2000 rpm, and 400 W output power.

Figure 4:
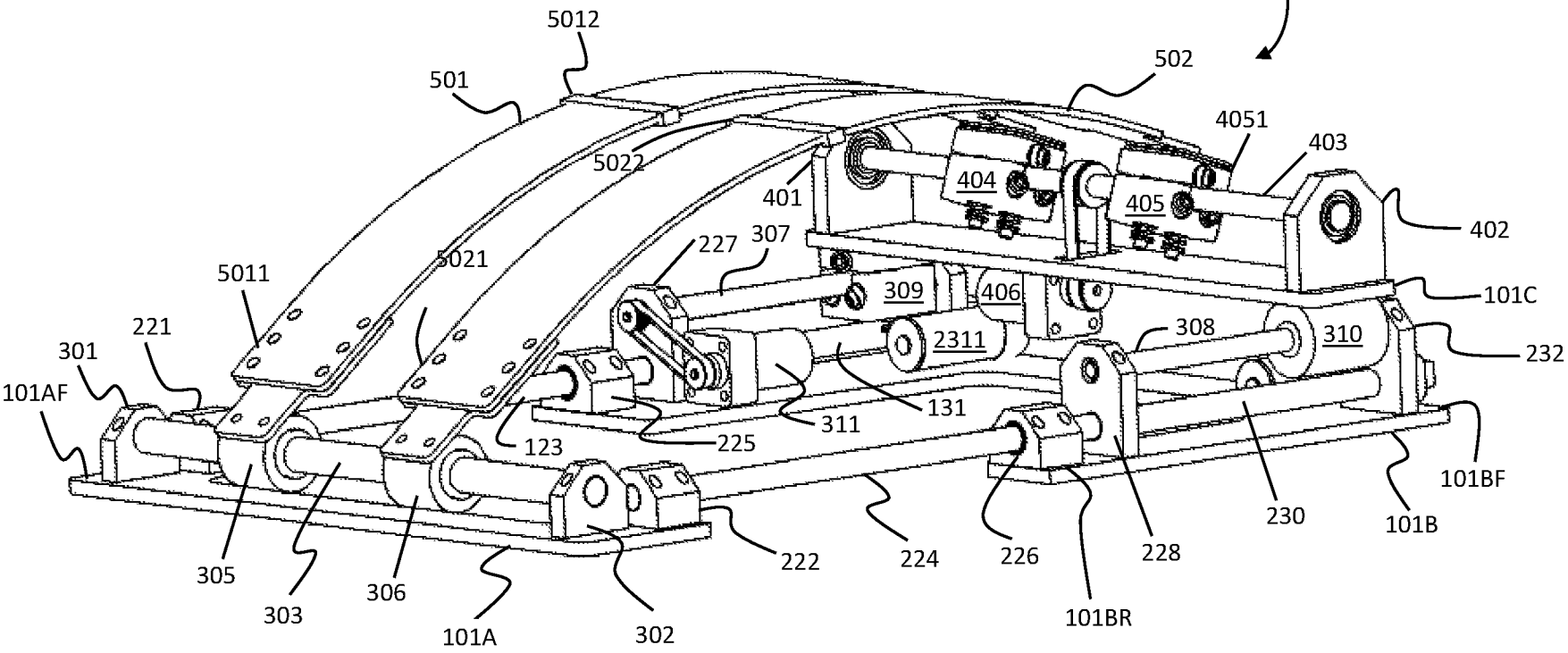
FIG. 4 is a 3D diagram illustrating a rear view of the portable surgical prone positioning device in accordance with an embodiment of the present invention.

Now referring to FIG. 4, a 3D rear view 4000 of portable prone surgical positioning device 1000 of FIG. 1 is illustrated. After assembling the components as shown in exemplary embodiments from FIG. 2 to FIG. 3, portable prone surgical positioning device 1000 also includes a first chest supporting frame 501 and a second chest supporting frame 502. In detail, first chest supporting frame 501 is fixedly connected between second linear actuator connector 404 and seventh connector 305. Similarly, second supporting pad 502 is fixedly connected between third linear actuator connector 405 and eighth connector 306.

Figure 5:
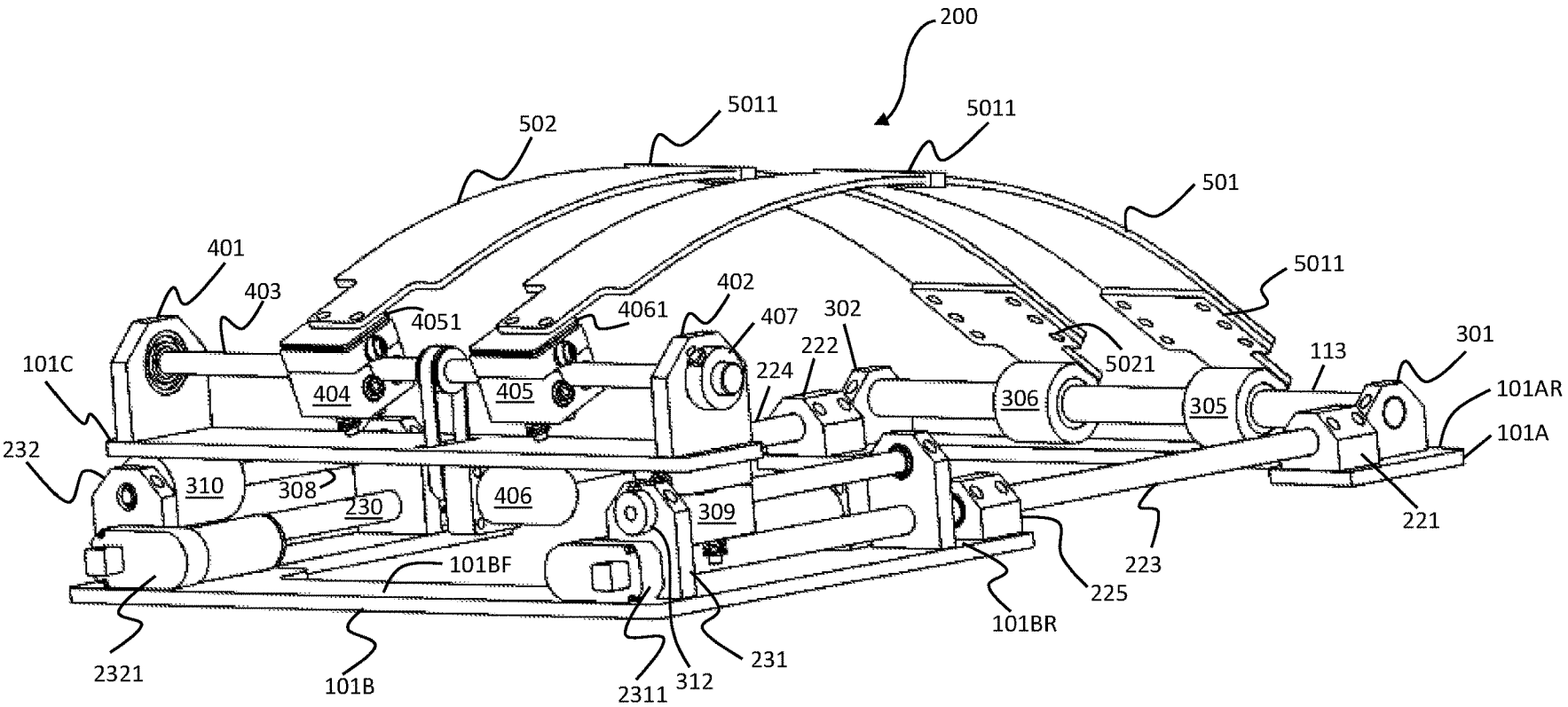
FIG. 5 is a 3D diagram illustrating a front view of the portable surgical prone positioning device in accordance with an embodiment of the present invention.

Now referring to FIG. 5, a 3D front perspective view 5000 of portable prone surgical positioning device 1000 of FIG. 1 is illustrated. From front perspective 5000, a first sensor 312 and a second sensor 407 can be seen. In many exemplary embodiments, first sensor 312 and second sensor 407 can be a potentiometer, a reed sensor, an optical sensor, or a Hall Effect sensor, or any position sensors that can record the positions of first linear actuator connector 309, second linear actuator connector 404, and third linear actuator connector 405.

Figure 6:
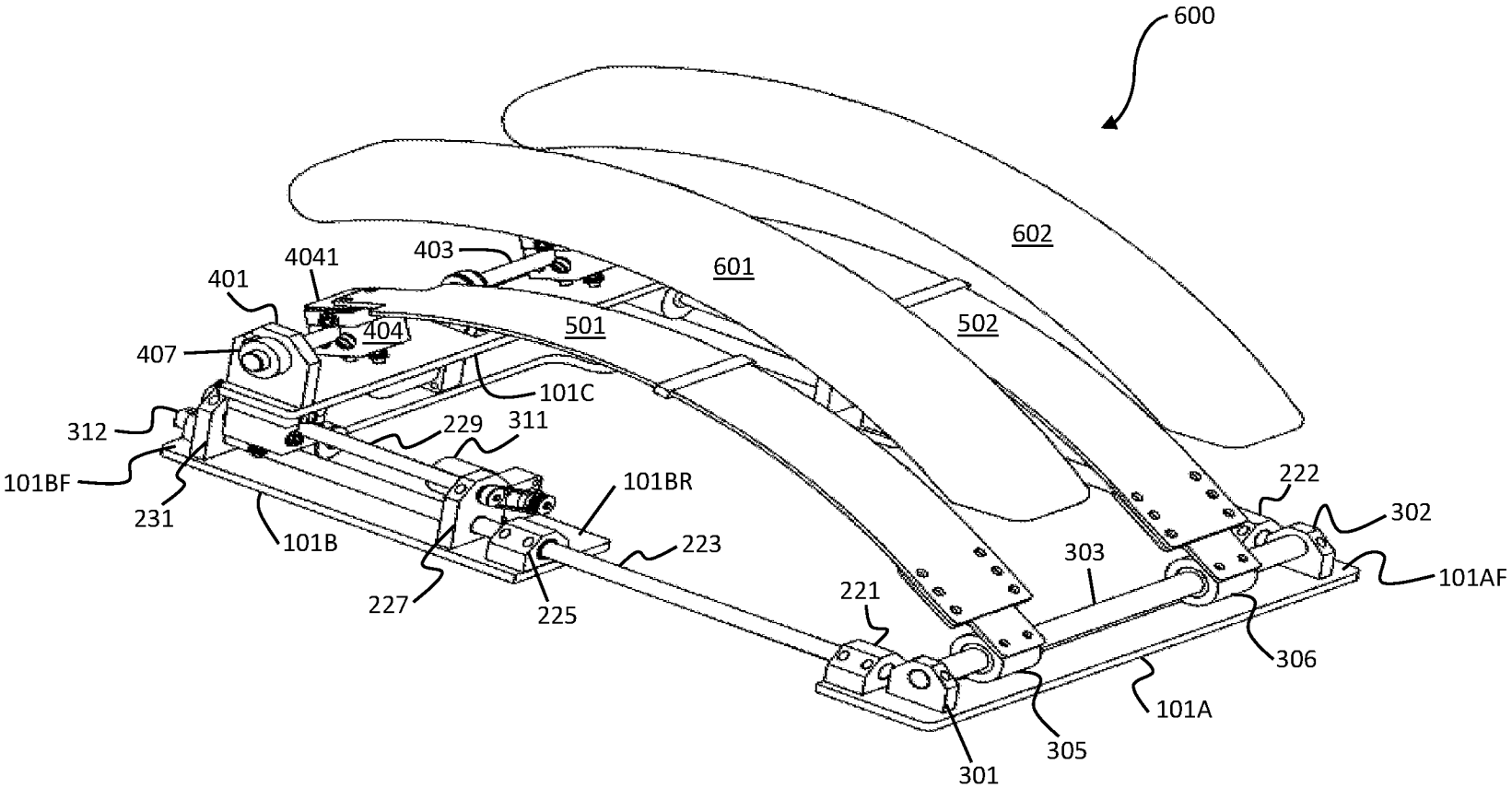
FIG. 6 is a 3D diagram illustrating a top view of the portable surgical prone positioning device in accordance with an embodiment of the present invention.

Next referring to FIG. 6, a 3D top view 6000 of portable prone surgical positioning device 1000 of FIG. 1 is illustrated. In an exemplary embodiment, portable prone surgical positioning device 1000 also includes a first cushion pad 601 snugly covering first chest supporting frame 501 and a second cushion pad 602 snugly covering second chest supporting frame 502.

Figure 7:
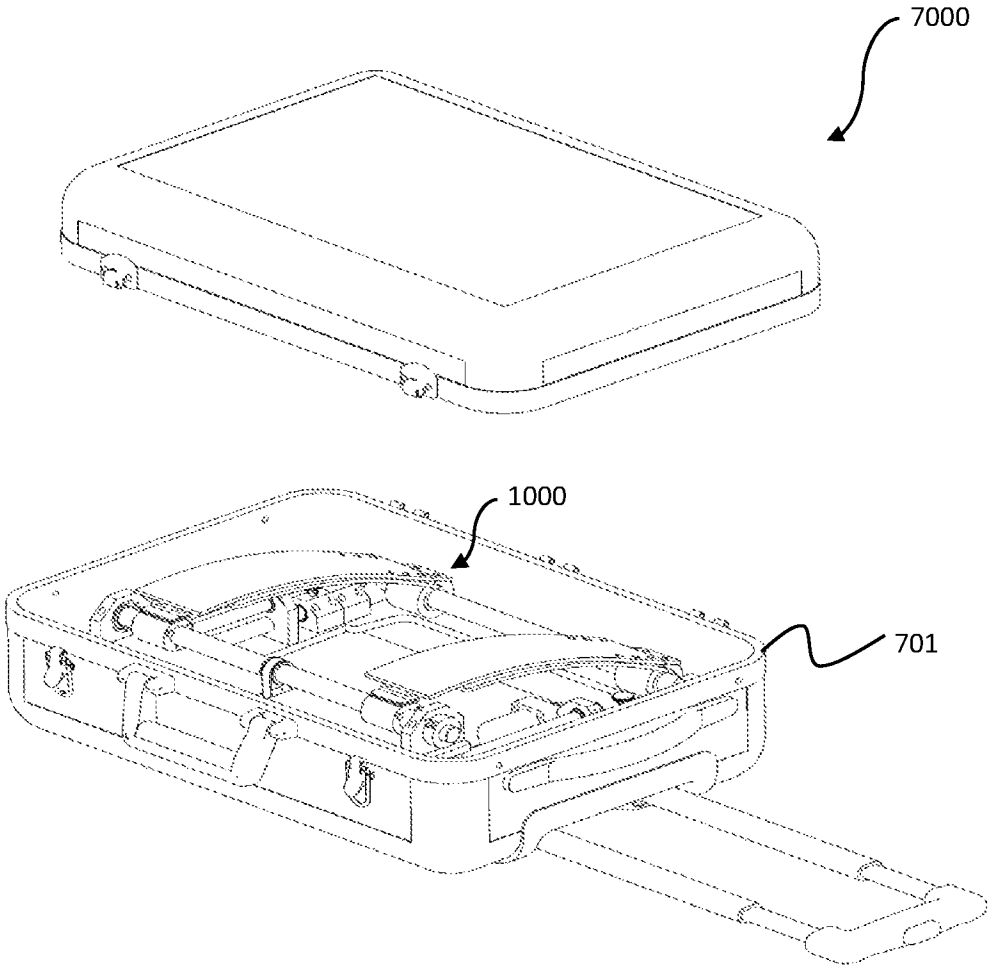
FIG. 7 is a 3D diagram illustrating the retracted portable surgical prone positioning device that fits inside a briefcase in accordance with an embodiment of the present invention.

Now referring to FIG. 7, a 3D diagram 7000 of retracted portable surgical prone positioning device 1000 that fits inside a briefcase in accordance with an embodiment of the present invention is illustrated. After use, prone surgical positioning device 1000 is retracted to its original size so that it can be stored in a briefcase 701.

Figure 8:
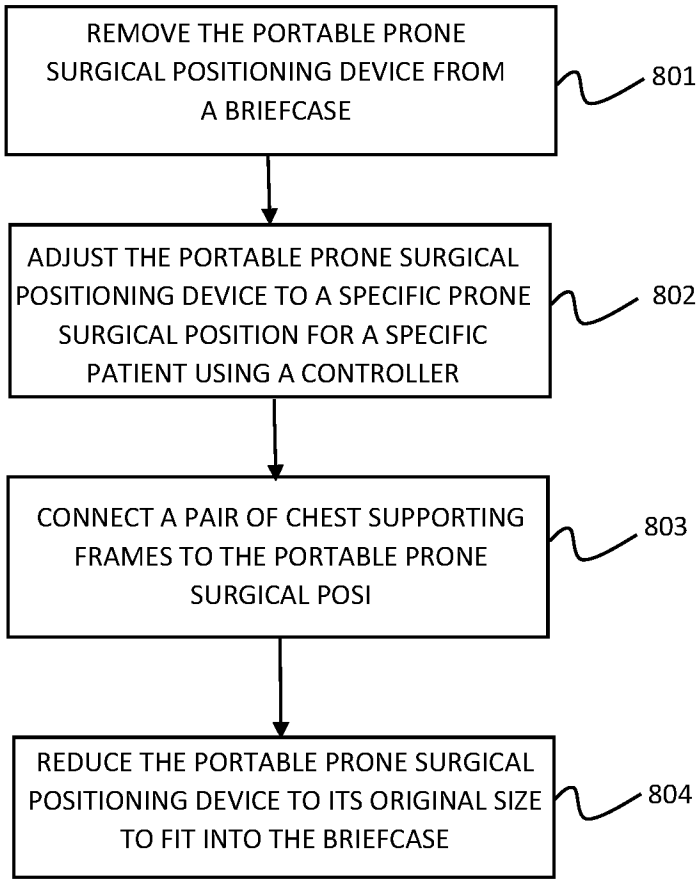
FIG. 8 is a flow chart illustrating the method of using a portable surgical prone positioning device in accordance with an embodiment of the present invention.

Finally referring to FIG. 8, a method 800 of providing a correct prone surgical position for a patient in accordance with an embodiment of the present invention.

At step 801, a portable prone surgical positioning device is removed from a briefcase.

At step 802, the portable prone surgical positioning device is adjusted to a specific prone surgical position measurements for a specific patient. In an exemplary embodiments, if the patient is new and has no measurements in the memory device, the portable prone surgical positioning device is adjusted either manually or by using a controller. Then the prone surgical positioning measurements which include a length, width, and curvature measurements are recorded in a memory device. In case the patient is used the portable prone surgical positioning device for a second time and his/her prone surgical position measurements are stored in the memory device, the controller can be used to recall and set the specific prone surgical positioning measurements for that specific patient. Step 802 is actualized by portable prone surgical positioning device 1000 and controller 700.

At step 803, a pair of chest supporting frames are firmly connected to the prone surgical positioning device. After the portable prone surgical positioning device has been set to the specific prone surgical position measurements, the pair of chest supporting frames are connected thereto. Afterward, the patient lays with his or her chest lean on the pair of chest supporting frames. Step 803 is realized by first chest supporting frame 501 and second chest supporting frame 502.

In one exemplary embodiment, first cushion pad 601 is coupled to first supporting frame 501 and second cushion pad 602 is coupled to second chest supporting frame 502 to provide further comfort to the patient.

At step 804, the portable prone surgical device is reduced to its original size that fits into the briefcase after the back surgery or any other back related treatments are complete.

The foregoing description details certain embodiments of the invention. It will be appreciated, however, that no matter how detailed the foregoing appears in text, the invention can be practiced in many ways. As is also stated above, it should be noted that the use of particular terminology when describing certain features or aspects of the invention should not be taken to imply that the terminology is being re-defined herein to be restricted to including any specific characteristics of the features or aspects of the invention with which that terminology is associated. The scope of the invention should therefore be construed in accordance with the appended claims and any equivalents thereof.

DESCRIPTION OF NUMERALS

100 base frame assembly
101A first platform
101AF first top front end of first platform
101AR first top rear end of first platform
101B second platform
101BF second top front end
101BR second top rear end
200 length varying assembly
221 first connector
222 second connector
223 first longitudinal sliding beam
224 second longitudinal sliding beam
225 third connector
226 fourth connector
227 first vertical double-barrel connector
228 second vertical double-barrel connector
229 first hollow tube
230 second hollow tube
231 third vertical double-barrel connector
2311 first linear actuator
232 fourth vertical double-barrel connector
2321 second linear actuator
300 curvature varying assembly
301 fifth connector
302 sixth connector
303 first horizontal sliding beam
305 first sliding connector
306 second sliding connector
307 third longitudinal sliding beam
308 fourth longitudinal sliding beam
309 first linear actuator connector
310 third sliding connector
311 first motor
3111 first pulley
3112 conveying belt
3113 second pulley
312 first sensor
400 width varying assembly
101C third platform
1011 opening
401 seventh connector
401 seventh connector ring
402 eighth connector
4021 eighth connector ring
403 second horizontal sliding beam
404 second linear actuator connector
4041 second linear actuator connector pad
405 third linear actuator connector
4051 third linear actuator connector pad
406 second motor
4061 first pulley
4062 coupling belt
4063 second pulley
407 second sensor
501 first chest supporting frame
5011 first chest supporting rear connector
5012 first chest supporting frame front connector
5013 first chest supporting frame clasp
502 second chest supporting frame
5021 second chest supporting frame rear connector
5022 second chest supporting frame front connector
5023 second chest supporting frame clasp
601 first cushion pad
602 second cushion pad
700 controller

What is claimed is:

1. A portable prone surgical positioning device, comprising:

an adjustable base frame assembly;

a pair of chest supporting frames releasably connected to said adjustable base frame assembly and in parallel to each other whereupon a patient lays in a prone position;

a width varying assembly, connected to said pair of chest supporting frames and said adjustable base frame, operable to vary a width of said chest supporting frames;

a length varying assembly, coupled to said base frame assembly, operable to change the length of said base frame assembly;

a curvature varying assembly; connected to said base frame assembly, said length varying assembly, and said width varying assembly; operable to change a curvature of said pair of chest supporting frames in two different manners by changing the length of said adjustable base and/or independently changing a second length of said curvature varying assembly, wherein said curvature varying assembly further comprises:

a first linear actuator connector coupled to move back and forth along a third longitudinal sliding beam;

a first motor coupled to rotate said third longitudinal sliding beam so as said first linear actuator move back and forth along said third longitudinal sliding beam;

a first sliding connector coupled to a fourth longitudinal sliding beam, capable of sliding back and forth along said fourth longitudinal beam.

2. The portable prone surgical positioning device of claim 1 wherein said length varying assembly and said width varying assembly are operable to change the length and the width of said adjustable base frame assembly so as to fit said portable prone surgical positioning device into a briefcase.

3. The portable prone surgical positioning device of claim 2 further comprising a controller having a memory capable of storing prone positions for different patients, wherein said controller retrieves a specific prone position and sends a command to control said width varying assembly, said curvature varying assembly, and said length varying assembly to adjust said portable prone surgical positioning device into said specific prone position for a specific patient.

4. The portable prone surgical positioning device of claim 3 wherein said adjustable base frame assembly further comprises:

a first platform having a first top front end and a first top rear end; and a second platform separate from said first platform, wherein said second platform having a second top front end and a second top rear end.

5. The portable prone surgical positioning device of claim 4 wherein said length varying assembly further comprises:

a first connector fixedly connected to the one side on said first top rear end of said first platform;

a second connector fixedly connected to the other side on said first top rear end of said first platform;

a third connector fixedly connected to the one side of said second top rear end, said third connector aligned in a straight line with said first connector; and a fourth connector fixedly connected to the other side of said second top rear end, said fourth connector aligned in a straight line with said second connector.

6. The portable prone surgical positioning device of claim 5 wherein said length varying assembly further comprises:

a first vertical double-barrel connector fixedly connected to the one side on said second top rear end, said first vertical double-barrel connector being aligned in a straight line with said third connector;

a second vertical double-barrel connector fixedly connected to the other side on said second top rear end, said second vertical double-barrel connector being aligned in a straight line with said fourth connector;

a third vertical double-barrel connector fixedly connected to the one side on said second top front end, said third vertical double-barrel connector being aligned with said first vertical double-barrel connector and said third connector; and a fourth vertical double-barrel connector fixedly connected to the other side on said second top front end, said fourth vertical double-barrel connector being aligned in a straight line with said second vertical double-barrel connector and said fourth connector.

7. The portable prone surgical positioning device of claim 6 wherein said length varying assembly further comprises:

a first longitudinal sliding beam having a proximal end fixedly coupled to said first connector and a distal end slidably coupled to said third connector;

a second longitudinal sliding beam having proximal end fixedly coupled to said second connector and a distal end slidably coupled to said fourth connector.

8. The portable prone surgical positioning device of claim 7 wherein said length varying assembly further comprises:

a first hollow tube having a first end connected to the bottom connector of said first vertical double-barrel connector and a second end connected to the bottom connector of said third vertical double-barrel connector, wherein said first hollow tube has an inner diameter slightly larger an outer diameter of said first longitudinal sliding beam so that said first hollow tube is capable of contain said first longitudinal sliding beam therein; and a second hollow tube having a first end connected to the bottom connector of said second vertical double-barrel connector and a second end connected to the bottom connector of said fourth vertical double-barrel connector, wherein said second hollow tube has an inner diameter slightly larger an outer diameter of said second longitudinal sliding beam so that said fourth hollow tube is capable of contain said second longitudinal sliding beam therein.

9. The portable frame for prone surgical positioning device of claim 8 wherein said length varying assembly further comprises:

a first linear actuator, connected to said first hollow tube, operable to extend or withdraw said first longitudinal sliding beam to and from said first hollow tube; and a second linear actuator connected to said second hollow tube, operable to extend or retract said second longitudinal sliding beam to and from said second hollow tube.

10. The portable prone surgical positioning device of claim 9 wherein said curvature varying assembly further comprises:

a third longitudinal sliding beam having a first end connected to a top connector of said first vertical double-barrel connector and a second end connected to a top connector of said third vertical double-barrel connector; and a fourth longitudinal sliding beam having the first end connected to a top connector of said second vertical double-barrel connector and a second end connected to a top connector of said fourth vertical double-barrel connector.

11. The portable prone surgical positioning device of claim 10 wherein said width varying assembly further comprises:

a fifth connector connected to the one side on said first top front end adjacent to said first connector;

a sixth connector connected to the other side on said first top front end of said first platform adjacent to said second connector;

a first horizontal sliding beam connected between said fifth connector and said sixth connector;

a second sliding connector coupled to slide back and forth along said first horizontal sliding beam; and a third sliding connector coupled to slide back and forth along said first horizontal sliding beam.

12. The portable prone surgical positioning device of claim 11 wherein said width varying assembly further comprises:

a third platform having a bottom surface and a top surface, wherein said bottom surface is fixedly connected to the top of said first linear actuator connector and said first sliding connector;

a seventh connector connected to the one side on the top surface of said third platform;

an eighth connector connected to the other side on the top surface of said third platform;

a second horizontal sliding beam having a first end rotatably connected to said seventh connector and a second end rotatably connected to said eighth connector, wherein said first horizontal sliding beam and said second horizontal sliding beam are arranged perpendicular to said first longitudinal sliding beam, said second longitudinal sliding beam, said third longitudinal sliding beam, and said fourth longitudinal sliding beam;

a second linear actuator connector coupled to slide back and forth along said second horizontal sliding beam;

a third linear actuator connector coupled to slide back and forth along said second horizontal sliding beam; and a second motor coupled to rotate said second horizontal sliding beam so as said second linear actuator connector and said third linear actuator connector are able to move back and forth along said second horizontal sliding beam.

13. The portable prone surgical positioning device of claim 11 wherein said second motor is coupled to rotate said second horizontal sliding beam by a first pulley connected to a second pulley by a coupling belt.

14. The portable prone surgical positioning device of claim 13 wherein said pair of chest supporting frames further comprises:

a first chest supporting frame connected between said second linear actuator connector and said second sliding connector;

a second chest supporting frame connected between said third linear actuator and said third sliding connector so that when said second motor rotates said second horizontal sliding beam, said second linear actuator connector, said third linear actuator connector, second sliding connector, and said third sliding connector slide along said first horizontal sliding beam and second horizontal sliding beam respectively to change said width between said first chest supporting frame and said second chest supporting frame.

15. The portable prone surgical positioning device of claim 14 further comprises:

a first sensor coupled to sense the position of said first linear actuator connector along said third longitudinal sliding beam; and a second sensor coupled to sense the positions of said second linear actuator connector and said third linear actuator connector along said second horizontal sliding beam.

16. The portable prone surgical positioning device of claim 1 wherein a specific curvature measurement of a specific patient is achieved by said curvature varying assembly by:

adjusting said length varying assembly to a first length measurement; and adjusting a second length of said curvature varying assembly independent of said first length measurement to achieve said specific curvature measurement when either said adjusting said length varying assembly to said first length measurement or said adjusting said second length of said curvature varying assembly alone is not sufficient to achieve said specific curvature measurement.

17. A method of providing a correct prone position for a patient during a spinal operation, comprising:

removing a portable prone surgical positioning device from a briefcase;

connecting a pair of chest supporting frames to said portable prone surgical positioning device;

adjusting said portable prone surgical positioning device according to specific prone surgical position measurements for a specific patient, wherein said specific prone surgical position measurements further comprising a specific length measurement, a specific curvature measurement, and a specific width measurement for said specific patient; and reducing said portable prone surgical positioning device into an original size that fits into said briefcase after use, wherein said portable prone surgical positioning device further comprises:

an adjustable base frame assembly;

said pair of chest supporting frames releasably connected to said adjustable base frame assembly and in parallel to each other whereupon a patient lays in a prone position;

a width varying assembly, connected to said pair of chest supporting frames and said adjustable base frame, operable to vary a width of said chest supporting frames to said specific width measurement;

a length varying assembly, coupled to said base frame assembly, operable to change the length of said base frame assembly to said specific length measurement;

a curvature varying assembly; connected to said base frame assembly, said length varying assembly, and said width varying assembly; operable to change a curvature of said pair of chest supporting frames in two different manners by changing the length of said adjustable base and/or independently changing a second length of said curvature varying assembly to said specific curvature measurement, wherein said curvature varying assembly further comprises:

a linear actuator connector coupled to move back and forth along a first longitudinal sliding beam;

a motor coupled to rotate said first longitudinal sliding beam so as said first linear actuator move back and forth along said first longitudinal sliding beam;

a sliding connector coupled to a second longitudinal sliding beam, capable of sliding back and forth along said second longitudinal beam.

18. The method of claim 17 wherein said step of adjusting said portable prone surgical positioning device to specific prone surgical position measurements for a specific patient further comprises:

sensing said specific prone surgical position measurements for said specific patient using a plurality of sensors; and storing said specific prone surgical position measurements into a memory device.

19. The method of claim 18 wherein said step of adjusting said portable prone surgical positioning device to specific prone surgical position measurements for a specific patient further comprises:

using a controller to retrieve said specific prone surgical position from said memory device when said specific patient uses said portable prone surgical positioning device again; and using said controller to extend said portable prone surgical positioning device according to said specific prone surgical position measurements for said specific patient.

20. The method of claim 19 further comprising:

adjusting said length varying assembly to a first length measurement; and adjusting a second length of said curvature varying assembly independent of said first length measurement to achieve said specific curvature measurement when either said adjusting said length varying assembly to said first length measurement or said adjusting said second length of said curvature varying assembly alone is not sufficient to achieve said specific curvature measurement.

* * * * *